United States Patent [19]

Linstromberg

[11] Patent Number: 4,619,221

[45] Date of Patent: Oct. 28, 1986

[54] INVENTORY INDICATING MEANS FOR REFRIGERATION APPARATUS

[75] Inventor: William J. Linstromberg, Lincoln Township, Berrien County, Mich.

[73] Assignee: Whirlpool Corporation, Benton Harbor, Mich.

[21] Appl. No.: 653,436

[22] Filed: Sep. 21, 1984

[51] Int. Cl.[4] ..... G09F 9/00

[52] U.S. Cl. ..... 116/307; 116/321; 116/323

[58] Field of Search ..... 116/323, 321, 322, 309, 116/312, 311, 313, 307

[56] References Cited

U.S. PATENT DOCUMENTS

| | | |
|---|---|---|
| 1,211,737 | 1/1917 | Martini . |
| 1,827,449 | 10/1931 | Wood et al. . |
| 1,936,558 | 11/1933 | Meyers . |
| 3,818,858 | 6/1974 | Kramer . |
| 3,973,514 | 8/1976 | Patrick . |

FOREIGN PATENT DOCUMENTS

| | | | |
|---|---|---|---|
| 519967 | 5/1953 | Belgium | 116/323 |

OTHER PUBLICATIONS

Portion of specification sheet for freezer manufactured by Liebherr-Hausgerate GmbH, no date.

Portion of specification sheet for freezer manufactured by Gram, no date.

Specification sheet of Thomson Freezer, no date.

*Primary Examiner*—Charles Frankfort

*Assistant Examiner*—Denis E. Corr

*Attorney, Agent, or Firm*—Wood, Dalton, Phillips, Mason & Rowe

[57] ABSTRACT

According to the invention, an inventory indicating device is provided having a slidable food type indicating member and associated date setting mechanism carried thereon. Indicia are provided along a guide track for selective alignment with a viewing aperture in the indicating member. With the indicia chosen according to a food type being stored, the date setting mechanism can be adjusted to reflect a storage date.

11 Claims, 6 Drawing Figures

INVENTORY INDICATING MEANS FOR REFRIGERATION APPARATUS

BACKGROUND OF THE INVENTION

1. Field of the Invention

This invention relates to refrigeration apparatus and, more particularly, to an adjustable inventory indicating means for visually indicating the date on which a particular item was stored in the apparatus.

2. Background Art

Frozen food items normally have a limited shelf life. Such items may be stored in the freezers for extended periods of time, and it is difficult for one to remember the dates that the items were placed in storage therein. As a result, the stored food may become impalatable or spoiled because of an excessive storage time.

One solution to the problem of inventorying the contents of a freezer is to individually label each item as it is placed in the freezer. This solution has serious drawbacks. Identifying labels adhesively bonded to the food item covering tend to fall off at freezing temperatures. If the label is placed within a transparent bag encasing the food item, the label often shifts and becomes hidden by the contents of the bag. Further, the writing may become illegible.

Further, because items in a freezer are generally stacked upon one another, it is often necessary to substantially rearrange the contents of the freezer to locate one particular item and observe its date of storage.

One solution has been to provide slots inside the freezer for receiving cards having indicia indicating the stored food type. The cards may be provided on their reverse sides with dates and other pertinent information entered by the user. It is inconvenient to provide written information on the cards and one cannot simultaneously observe both the food type and the written information. Each card must be turned over to compare dates and food type.

In another known system, individual rings are placed over food indicia on the face of slidable drawers. The system does not contemplate an indication of date of storage.

One other known inventorying system utilizes separate date and content indicia which must be correlated by color. It is inconvenient to have to match the separate indicia. This additional step also introduces the possibility of misinterpreting the information.

SUMMARY OF THE INVENTION

The present invention is specifically directed to overcoming the above discussed problems in a novel and simple manner.

According to the invention, an inventory indicating device is provided having a slidable food type indicating member defining a viewing aperture and having an associated date setting mechanism carried thereon. Different food type indicia are provided on a guide track upon which the indicating member is slidably mounted. Upon locating the indicating member so that the viewing aperture is superimposed over the selected indicia, according to a food type being stored, the date setting mechanism is adjusted to indicate the storage date. In the illustrated embodiment, a rotatable date setting mechanism surrounds the viewing aperture on the indicating member.

The structure is simple and inexpensive, yet provides a clearly visible and readily understood indication of the storage date for a particular food stored in the apparatus in the adjacent compartment.

In the event that more than one food type is stored in any given compartment, additional indicating members, each with an associated date setting mechanism, may be provided on the same guide track.

Other objects and advantages of the invention will become apparent upon reviewing the following detailed description taken in conjunction with the drawings and the appended claims.

DETAILED DESCRIPTION OF THE INVENTION

Figure 1:
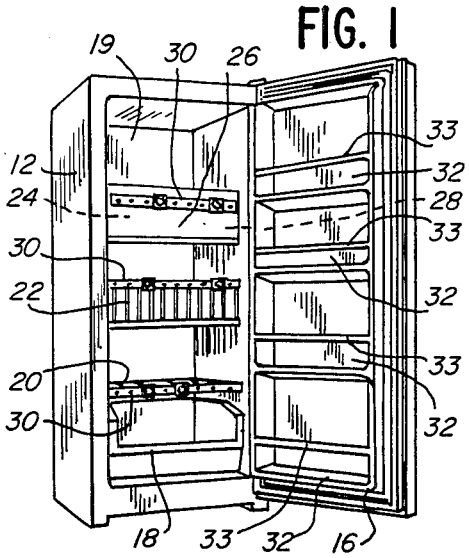
FIG. 1 is a perspective view of an upright freezer incorporating a preferred embodiment of the invention.
Figure 2:
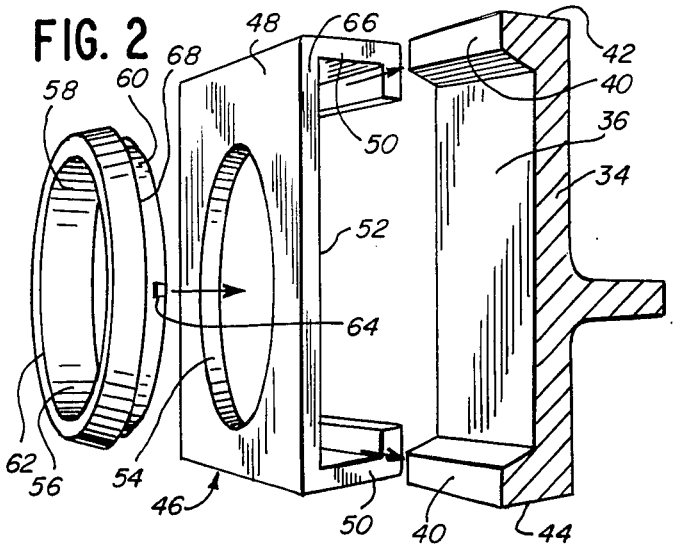
FIG. 2 is an exploded perspective view showing the relationship of the major components of the inventory indicating device.

FIG. 1 shows an upright freezer at 10 illustrative of one type of refrigeration apparatus to which the present invention is adapted. The invention is operable with refrigeration apparatus other than freezers.

Freezer 10 comprises a cabinet 12 defining an internal storage space 14, which is sealingly closed by a hinged door 16. To efficiently utilize the freezer 10, the storage space 14 is compartmentalized. A bulk storage basket 18 is provided on the bottom of space 14. Immediately above the basket 18 is a flat storage shelf 20. Additional storage is provided in a second bulk storage basket 22 above the shelf 20, and a subcompartment 24 above the basket 22. Subcompartment 24 is selectively closed by a door 26, hinged for rotation about a horizontally oriented hinge 28. The door 26 may be manipulated by means of an integrally formed handle. Additional storage in the main door 16 is provided by shelves 32 thereon, each shelf having a corresponding food retaining rail 33.

Details of the inventory indicating device 30 are shown in FIGS. 2 through 6. A guide track 34 has a flat display surface 36 wherein indicia 38 representing various food types are carried. Guide track 34 has vertically spaced, turned edge flanges 40 projecting forwardly from display surface 36. Flanges 40 define upper and lower guide edges 42 and 44 respectively, for controlled, adjustable sliding movement of an indicating member 46 thereon.

Indicating member 46 defines wall 66 and, attached thereto, rearwardly extending L-shaped legs 50 which slidingly embrace end flanges 40 of guide track 34 to permit relative sliding movement of the member 46 along the length of the guide track.

A circular opening 54 is provided through the wall 66 for rotatably mounting a date setting dial 56. Dial 56 is ring-shaped and defines a central viewing aperture 58, a reduced diameter rim 60 which is fitted in the opening 54, and an indicia carrying surface 62 which caries indicia comprising numbers 1 through 12 to correspond to the twelve months of the year. Wall 66 has a front display surface 48 inscribed with an indicating mark 72 adjacent opening 54.

Dial 56 is rotatably retained in opening 54 by a plurality of peripherally spaced ramped tabs 64. The tabs deflect radially inward upon urging of the dial toward the display surface 48 and, upon clearing the underside 52 of the wall 66, are returned outwardly to embrace wall 66 of the indicating member between the tabs and a shoulder 68 defined by the reduced diameter rim 60.

Figure 3:
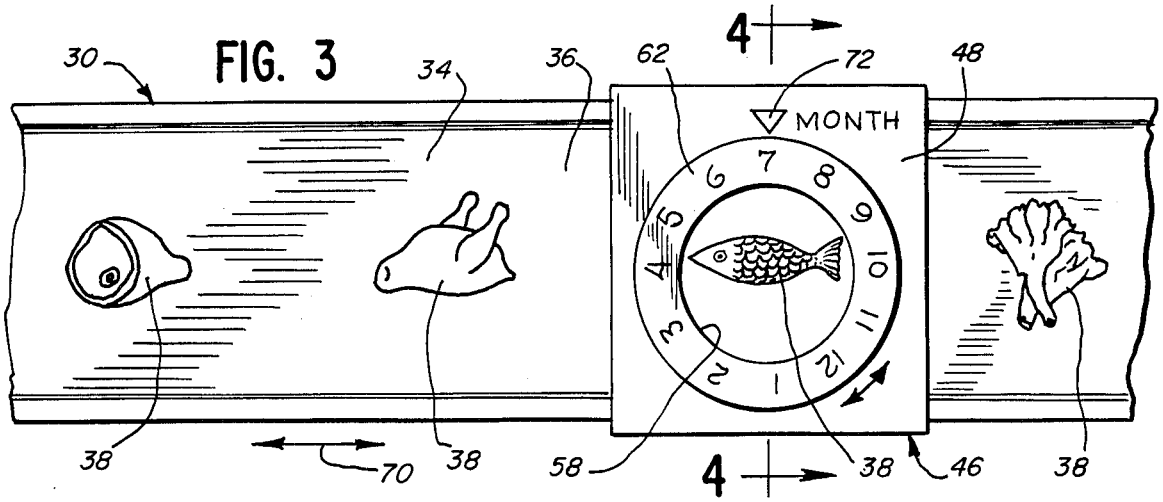
FIG. 3 is a front view of the preferred form of the invention illustratively set to indicate a date for one food type.

In operation, indicating member 46 is slidably adjusted relative to the guide track 34 along the line designated by the double headed arrow 70 of FIG. 3, until a selected one of the indicia 38, corresponding to the type of food placed in freezer 10, is visible in the central viewing aperture 58. The date setting dial 56 is rotated to align one of the twelve numbers, corresponding to the month when the food is placed in the freezer, with the indicating mark 72 on display surface 48 of the indicating member. For example, the arrangement shown in FIG. 3 indicates that fish were stored in the freezer in July. A plurality of different food types stored in the compartment may be indicated by a corresponding plurality of indicating members 46 on the track 34.

The components of the indicating device may be molded of synthetic resin, so as to be extremely simple and economical of manufacture.

The indicating member may be positively located on the guide track and the setting of the device positively maintained with the date and food type indications clearly apparent to the user. To assist the ready observation of the particular food type, the indicia 38 may be multi-colored pictorial representations of food items, as shown, or may alternatively be written descriptions thereof. In addition, a blank area may be provided on display surface 36 for the user to inscribe a desired indicium.

Figure 4:
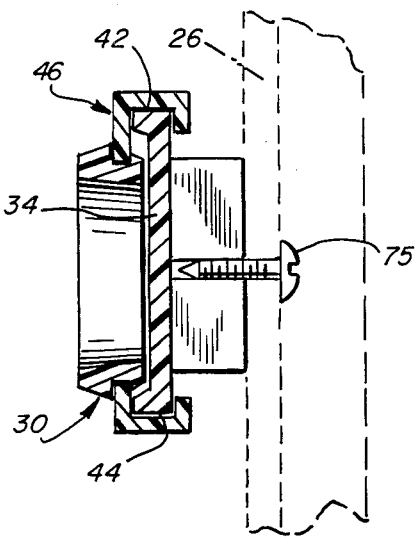
FIG. 4 is a sectional view along 4—4 of FIG. 3 with the guide track shown as integral with a handle for a door associated with a freezing compartment.
Figure 5:
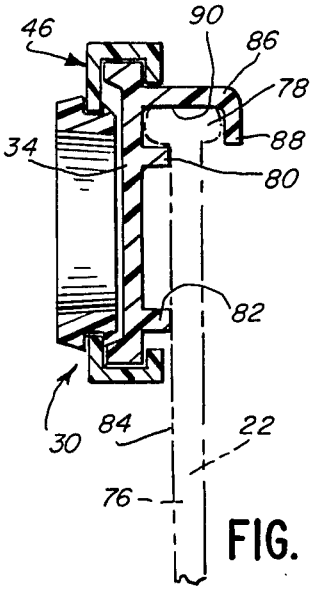
FIG. 5 is a sectional view of the inventory indicating device similar to that of FIG. 4 but wherein the guide track, in a modified form, is mounted on a basket associated with the freezer.
Figure 6:
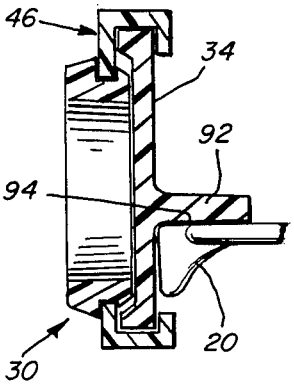
FIG. 6 is a sectional view of the inventory indicating device similar to that of FIG. 4 but wherein the track, in a modified form, is mounted on a freezer shelf.

FIGS. 4, 5 and 6 illustrate alternative means for mounting of guide track 34 in the freezer. In FIG. 4, guide track 34 serves as a handle for the door 26. A number of spaced mounting studs 74 are integrally molded with the guide track member 34 along the length thereof and are attached to the face of door 26 by screws 75. Preferably, studs 74 are located centrally between the upper and lower guide edges 42 and 44 to facilitate grasping of the guide track/handle.

FIG. 5 illustrates a mounting of the guide track 34 to a freezer basket 22. The freezer basket 22 normally comprises upright wires 76 with an upper rim 78 defining a flat upper surface. The guide track 34 is provided with bearing legs 80 and 82 extending rearwardly therefrom which abut the front surfaces 84 of the wires 76. The upper leg 80 cooperates with a bent leg 86 having a turned free end 88. End 88 and leg 80 define a groove 90 for receiving rim 78. In order to attach guide track 34, rim 78 is pressed against end 88 and leg 80 to deflect the free end 88 until the rim is fully seated into groove 90 at which time the end 88 springs back to positively retain the rim.

FIG. 6 shows a structure for mounting guide track 34 to the front portion of horizontal shelf 20 comprising a stem 92 extending perpendicularly from the plane of wall 66 on guide track 34. The wall 66 and stem 92 define a corner within which the front portion 94 of shelf 20 is received. The shelf and stem 94 may be held together in a known manner.

Guide track 34 can likewise be attached to bulk storage basket 18 or rails 33 associated with door shelves 32 in a manner similar to the mounting techniques shown in FIGS. 4, 5 and 6.

Having described the invention, the embodiments of the invention in which an exclusive property or privilege is claimed are defined as follows:

1. In a refrigeration apparatus having a cabinet defining a compartment for storing food items at refrigerated temperatures, and a food support member within said compartment defining a forward portion associated with an improved inventory indicating structure comprising:

an elongated guide track attached to said forward portion;

a plurality of first indicia distributed along said track, each indicium of said first indicia representing a food type;

indicating means adjustably, slidably mounted to said track and defining a viewing aperture for alignment selectively with a selected indicium;

data means comprising a date setting dial adjustably, rotatably mounted to said indicating means, said dial surrounding said viewing aperture;

a mark provided on one of said dial and said indicating means, and a plurality of second indicia on the other of said dial and said indicating means, said viewing aperture being selectively slidable into alignment with and to make readily visible from in front of said forward portion a selected first indicium corresponding to the type of food item that is being stored on said food support member and said date setting dial being selectively rotatable to align a selected second indicium with said mark to provde an indication of the time when the food item was stored, whereby through said inventory indicating structure a determination of the length of storage time of the food item can be made without physically examining the item on said support member.

2. The refrigeration apparatus according to claim 1 wherein a plurality of such indicating means and date setting means are provided, whereby it is possible to simultaneously maintain the single date inventory status of more than one food type.

3. The refrigeration apparatus according to claim 1 wherein each of said first indicia comprises a pictorial representation of a food type.

4. The refrigeration apparatus according to claim 1 wherein each of said first indicia comprises a written description of a food type.

5. The refrigeration apparatus according to claim 1 wherein said guide track includes at least one blank area for the apparatus user to inscribe an indicium.

6. The refrigeration apparatus according to claim 1 wherein said food support member comprises a storage shelf and said forward portion comprises the front edge of said shelf.

7. The refrigeration apparatus according to claim 1 wherein said food support member comprises a cabinet door shelf and said forward portion comprises a retaining rail attached to said cabinet door adjacent said shelf.

8. The refrigeration apparatus according to claim 1 wherein said food support member comprises a bulk storage basket and said forward portion comprises the front wall of said basket.

9. The refrigeration apparatus according to claim 1 wherein said food support member comprises a subcompartment and said forward portion comprises a door means for selectively closing said subcompartment.

10. The refrigeration apparatus according to claim 9 wherein said guide track is attached to said door means by a plurality of mounting studs and said inventory indicating structure comprises the handle for manipulating said door means between open and closed positions.

11. The refrigeration apparatus according to claim 1 wherein means are provided to snap-fit said date setting dial into an opening in said indicating means, said viewing aperture being within said opening.

* * * * *